US006987350B2

(12) United States Patent
Kim et al.

(10) Patent No.: US 6,987,350 B2
(45) Date of Patent: Jan. 17, 2006

(54) INNER SHIELD AND CATHODE RAY TUBE INCLUDING THE SAME

(75) Inventors: Jong-Heon Kim, Suwon (KR); Eung-Suk Lee, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 121 days.

(21) Appl. No.: 10/640,501

(22) Filed: Aug. 12, 2003

(65) Prior Publication Data

US 2004/0080254 A1 Apr. 29, 2004

(30) Foreign Application Priority Data

Aug. 12, 2002 (KR) ..... 10-2002-0047554
May 19, 2003 (KR) ..... 10-2003-0031666

(51) Int. Cl.
*H01J 29/80* (2006.01)

(52) U.S. Cl. ..... 313/402; 313/403; 313/313; 313/479

(58) Field of Classification Search ..... 313/402, 313/403, 479, 313
See application file for complete search history.

(56) References Cited

U.S. PATENT DOCUMENTS

2001/0026119 A1 * 10/2001 Murai et al. ..... 313/433

* cited by examiner

*Primary Examiner*—Vip Patel
(74) *Attorney, Agent, or Firm*—Christie, Parker and Hale, LLP

(57) ABSTRACT

An inner shield for a cathode ray tube includes a screen opening and an electron gun opening through which electron beams pass, and a main body including a pair of long sections and a pair of short sections interconnected to form the screen opening and the electron gun opening. A cathode ray tube includes the inner shield. Each of the short sections includes a cutaway section having a pair of first cutaway sections formed starting from the electron gun opening and extending at a predetermined angle for a predetermined distance toward the screen opening, and a second cutaway section formed starting from where the first cutaway sections end and extending inwardly toward the screen opening, the second cutaway section being formed to extend past imaginary lines formed from where the first cutaway sections end to a furthermost inward point of the second cutaway section, that is, the point of the second cutaway section closest to the screen opening.

24 Claims, 12 Drawing Sheets

INNER SHIELD AND CATHODE RAY TUBE INCLUDING THE SAME

CROSS REFERENCE

This application claims priority to and the benefit of Korean Patent Application No. 2002-47554 filed on Aug. 12, 2002 and Korean Patent Application No. 2003-31666 filed on May 19, 2003, the entire disclosures of which are incorporated herein by reference.

BACKGROUND OF THE INVENTION (a) Field of the Invention

The present invention relates to an inner shield for a color cathode ray tube, and more particularly, to an inner shield for a color cathode ray tube that effectively blocks external magnetic fields such as the earth's magnetic field to thereby minimize mis-landing of electron beams caused by fluctuations in the external magnetic fields. The present invention also relates to a cathode ray tube including the inner shield.

(b) Description of the Related Art

A color cathode ray tube (CRT) is a display device in which a phosphor screen is scanned by three electron beams emitted from an electron gun to realize specific images. A path of the three electron beams is altered by the earth's magnetic field, which is created by the earth's north and south magnetic poles, to thereby negatively affect purity, raster position, and convergence characteristics of the CRT.

The earth's magnetic field includes a vertical component that is vertical with respect to the earth's surface (earth's vertical magnetic field), and a horizontal component that is horizontal to the earth's surface (earth's horizontal magnetic field). Movement of the electron beams by the earth's horizontal magnetic field may be divided into North-South (N-S) electron beams movement and East-West (E-W) electron beams movement, depending on the direction of the CRT.

That is, with reference to FIG. 1A, N-S movement refers to electron beam movement as a result of the magnetic field (indicated by the arrows) in the vertical direction in the figure (N-S direction) that is parallel to a tube axis Z of the cathode ray tube. Further, with reference to FIG. 1B, E-W movement refers to electron beam movement as a result of the magnetic field (indicated by the arrows) in the horizontal direction in the figure (E-W direction) that is parallel to the screen of the cathode ray tube.

Forces received by the electron beams caused by the earth's magnetic field include a horizontal component and a vertical component. It is mostly the horizontal component that affects picture characteristics of the CRT. This is because with the shadow mask having elongated vertical slots used mainly in consumer CRTs(also referred to as color picture tube) and the shadow mask having dot-shaped holes used mainly in commercial CRTs(also referred to as color display tube), the horizontal component that moves the electron beams in the horizontal direction (x-axis direction) moves the electron beams away from their designated slots or holes.

Therefore, an inner shield is mounted within the CRT to minimize movement of the electron beams caused by the influence of the earth's magnetic field. A conventional inner shield is shown in FIG. 2.

An inner shield 100 causes offset or reinforcing interference with the earth's magnetic field in areas surrounding the path of the electron beams to thereby vary distribution of the earth's magnetic field (in these areas) in directions that minimize changes in the landing of the electron beams. The inner shield 100 is mounted to a mask frame (not shown) and surrounds a path of the electron beams within a funnel (not shown) of the CRT. The inner shield 100 includes an electron gun opening 102 and a screen opening 104 through which the electron beams pass, and a pair of long sections 106 and a pair of short sections 108. The long sections 106 and the short sections 108 are interconnected to form the electron gun opening 102 and the screen opening 104.

Formed at the end of each of the short sections 108 forming the electron gun opening 102, is a V-shaped cutaway section 110 for minimizing N-S electron beams movement. A depth h of the V-shaped cutaway sections 110, which is measured from an apex of the V-shaped cutaway sections 110 to imaginary lines formed flush with edges of the long sections 106 forming the electron gun opening 102, is inversely proportional to an amount of N-S electron beams movement and directly proportional to an amount of E-W electron beams movement. That is, the greater the depth h of the V-shaped cutaway sections 110, the greater the reduction in the amount of N-S electron beams movement and the greater the increase in the amount of E-W electron beams movement.

As a result of this adverse affect on E-W electron beams movement while favorably affecting N-S electron beams movement, the depth h of the V-shaped cutaway sections 110 is limited to a predetermined range. This means that N-S electron beams movement may be controlled only up to a point.

FIG. 3 shows a one-quarter section of a screen, where the x-axis indicates a distance in the horizontal direction from a center 0 of the screen, and the y-axis a distance in the vertical direction from the center 0 of the screen.

With reference to FIG. 3, since the cutaway sections are formed as V-shaped elements in the conventional inner shield 100, although the amount of N-S electron beams movement is effectively reduced in a corner area ③, there is limited reduction in the amount of N-S electron beams movement in the remaining areas of measurement (①, ②, ④, and ⑤). In particular, in the area ④ that has an insufficient amount of screen margin (also referred to as overspill margin), an effective reduction in N-S electron beams movement is unable to be realized such that the overall quality of the CRT is reduced.

Screen margin refers to the amount of margin that exists before the electron beams land on adjacent phosphors of another color when landing errors occur. Screen margin is affected by such factors as pitch, phosphor width, electron beam size (mask hole size), landing errors, and phosphor arrangement errors.

In a CRT where the mask and screen are formed in a globe-like shape about a line passing through a tube axis of the electron gun, deviation in the emission angle of the electron beams results in identical amounts of deviation over the entire area of the screen. However, in a CRT where the mask and screen are formed in a flat configuration, the amount of deviation on the screen is not identical over the entire area of the screen. That is, for a flat screen, the same deviation in the emission angle of the electron beams translates into larger amounts of deviation on the screen at peripheral areas thereof. It is for this reason that there is an insufficient screen margin in the area ④ as described above.

SUMMARY OF THE INVENTION

In one embodiment, the present invention provides an inner shield for a color cathode ray tube that effectively reduces N-S electron beams movement, while at the same time preventing increases in the amount of E-W electron beams movement. The present invention also provides a cathode ray tube having the inner shield.

An inner shield for a cathode ray tube includes a screen opening and an electron gun opening through which electron beams pass, and a main body including a pair of long sections and a pair of short sections interconnected to form the screen opening and the electron gun opening. Each of the short sections includes a cutaway section having a pair of first cutaway sections formed starting from the electron gun opening and extending at a predetermined angle for a predetermined distance toward the screen opening, and a second cutaway section formed starting from where the first cutaway sections end and extending inwardly toward the screen opening, the second cutaway section being formed to extend past imaginary lines formed from where the first cutaway sections end to a furthermost inward point of the second cutaway section, that is, the point of the second cutaway section closest to the screen opening.

In one exemplary embodiment, the second cutaway section is formed as a circular arc or in substantially a circular arc configuration. In this case, if the second cutaway section is extended using imaginary lines to complete the circle started by its circular arc shape, a center of this circle is closer to or alternatively, farther from the screen opening than an imaginary line formed by connecting two points of the first cutaway sections where each of the first cutaway sections start in the electron gun opening.

In another exemplary embodiment, the second cutaway section is formed as a predetermined section of an ellipse or in substantially an elliptical form (ellipse). In this case, if the second cutaway section is extended using imaginary lines to complete the ellipse, a center of this ellipse is closer to or alternatively, farther from the screen opening than an imaginary line formed by connecting two points of the first cutaway sections where each of the first cutaway sections start in the electron gun opening.

In another exemplary embodiment, if an imaginary line is drawn between two points where the first cutaway sections end, the second cutaway section is formed as a trapezoid with the imaginary line forming the base of the trapezoid.

In the case of a consumer CRT(also referred to as color picture tube) having a slot-type phosphor pattern, the present invention is configured with a depth of the cutaway sections being 50% or less of a height of the inner shield, preferably between 44 and 48% of the height of the inner shield. Here, the height of the inner shield is measured as a length between the electron gun opening and the screen opening, and the depth of the cutaway sections is measured in the same direction. Such a configuration ensures that E-W electron beams movement does not abruptly increase.

In the case of a commercial CRT(also referred to as color display tube) having a dot-type phosphor pattern, the present invention is configured with the depth of the cutaway sections being equal or greater than 50% of the height of the inner shield.

BRIEF DESCRIPTION OF THE DRAWINGS

The accompanying drawings, which are incorporated in and constitute a part of the specification, illustrate an embodiment of the invention and together with the description, serve to explain the principles of the invention.

DETAILED DESCRIPTION

Embodiments of the present invention will now be described in detail with reference to the accompanying drawings.

Figure 4:
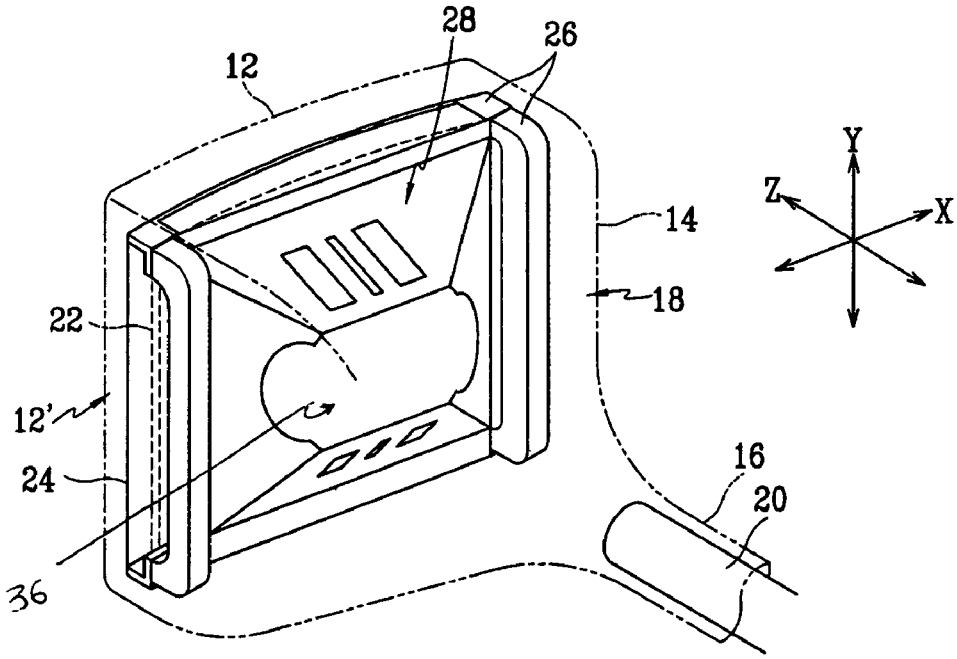
FIG. 4 is a rear perspective view of a cathode ray tube having an inner shield, according to an embodiment of the present invention.

FIG. 4 is a rear perspective, transparent view of a cathode ray tube having an inner shield according to an embodiment of the present invention.

With reference to the drawing, a cathode ray tube (CRT) 10 according to an embodiment of the present invention includes a face panel 12, a neck 16, and a funnel 14 interconnecting the face panel 12 and the neck 15. The face panel 12, neck 16, and funnel 14 form a tube assembly 18, an inside of which is maintained in a high vacuum state.

A phosphor screen 12' is formed on an inner surface of the face panel 12. The phosphor screen 12' is realized through a plurality of red, green, and blue phosphors. An electron gun 20 that emits electron beams toward the phosphor screen 12' is mounted within the neck 16. Also, a deflection yoke (not shown) is mounted to an outer circumference of the funnel 14. The deflection yoke generates a deflection magnetic field for deflecting the electron beams emitted from the electron gun 20.

A shadow mask 24 having a plurality of electron beam apertures 22 formed therein is suspended at a predetermined distance from the phosphor screen 12' of the face panel 12 by a mask frame 16. One end of a magnetic blocking device, that is, an inner shield 28, is mounted to the mask frame 26. The inner shield 28 encompasses a section of the path of the electron beams.

In the CRT 10 structured as in the above, electron beams (not shown) corresponding to picture signals emitted from the electron gun 20 are deflected by the magnetic field generated by the deflection yoke and pass through the electron beam apertures 22 of the shadow mask 24 to undergo color separation and thereby land on designated phosphors of the phosphor screen 12'.

In the above process, a path of the electron beams is varied by influence of external magnetic fields. A horizontal force Fx and a vertical force Fy acting on each of the electron beams may be respectively expressed as:

$$Fx=-e(VyBz-VzBy)$$

$$Fy=-e(VxBz-VzBx), \quad \text{[equation 1]}$$

where e is the electric charge in coulombs (C); Vx, Vy, and Vz are velocities (m/s) of the electron beams in a horizontal direction (x-axis), a vertical direction (y-axis), and a tube axis direction (z-axis) of the CRT 10; respectively. Bx, By, and Bz are strengths (T) of the components of the earth's magnetic field in the horizontal direction (x-axis), vertical direction (y-axis), and the tube axis direction (z-axis) of the CRT 10 respectively.

As is evident from equation 1, the force Fx acting on each of the electron beams in the horizontal direction is determined by the strengths of the earth's magnetic field in the peripheries of each of the electron beams, if the electron beam velocities are constant. That is, the force Fx is proportional to the difference between Bz and By. Similarly, the force Fy acting on the electron beams in the vertical direction is proportional to the difference between Bz and Bx, when it is assumed that the electron beam velocities are constant.

Therefore, it is clear that in order to reduce movement of the electron beams caused by external magnetic fields, the component Bz that is parallel to the tube axis (z-axis) of the CRT 10 must be induced toward the component Bx or the component By. The inner shield of the present invention varies the distribution of magnetic fields using a structure described below such that N-S electron beams movement of the electron beams is minimized. In the embodiments described below, the inner shield is by way of example, approximately 184 mm in length and approximately 161 mm in height.

Figure 5:
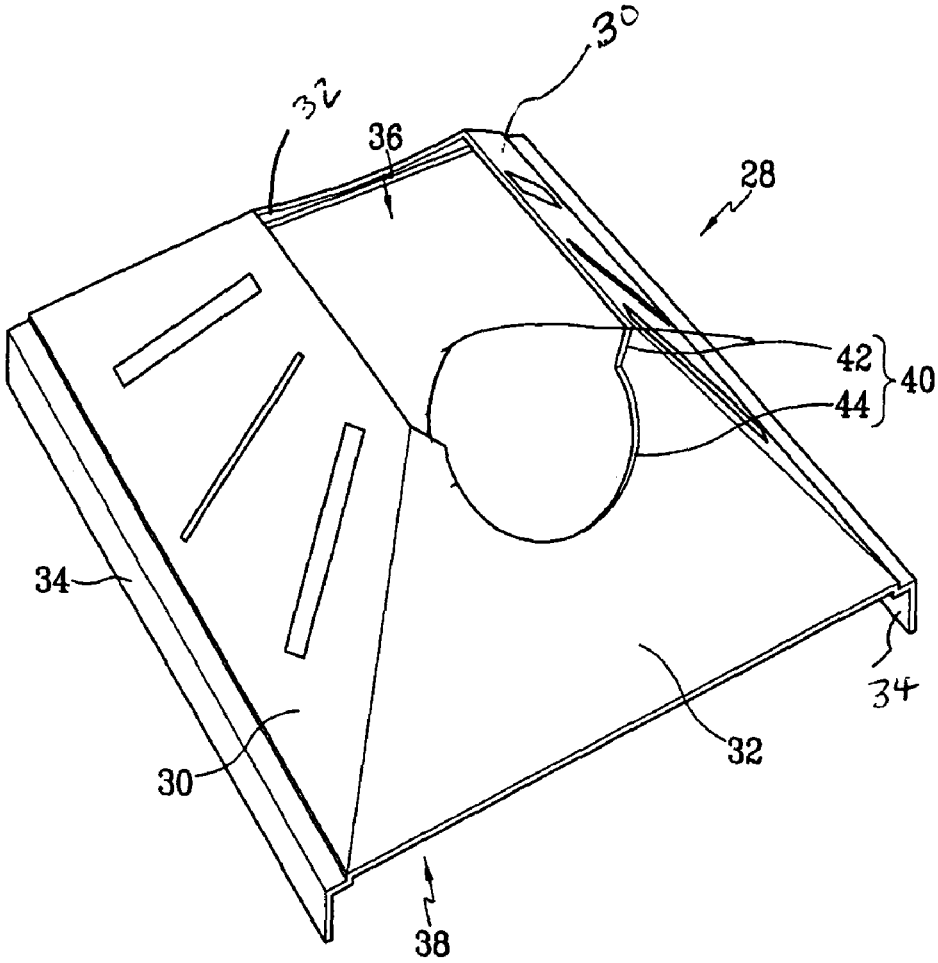
FIG. 5 is a perspective view of an inner shield according, to a first embodiment of the present invention.
Figure 6:
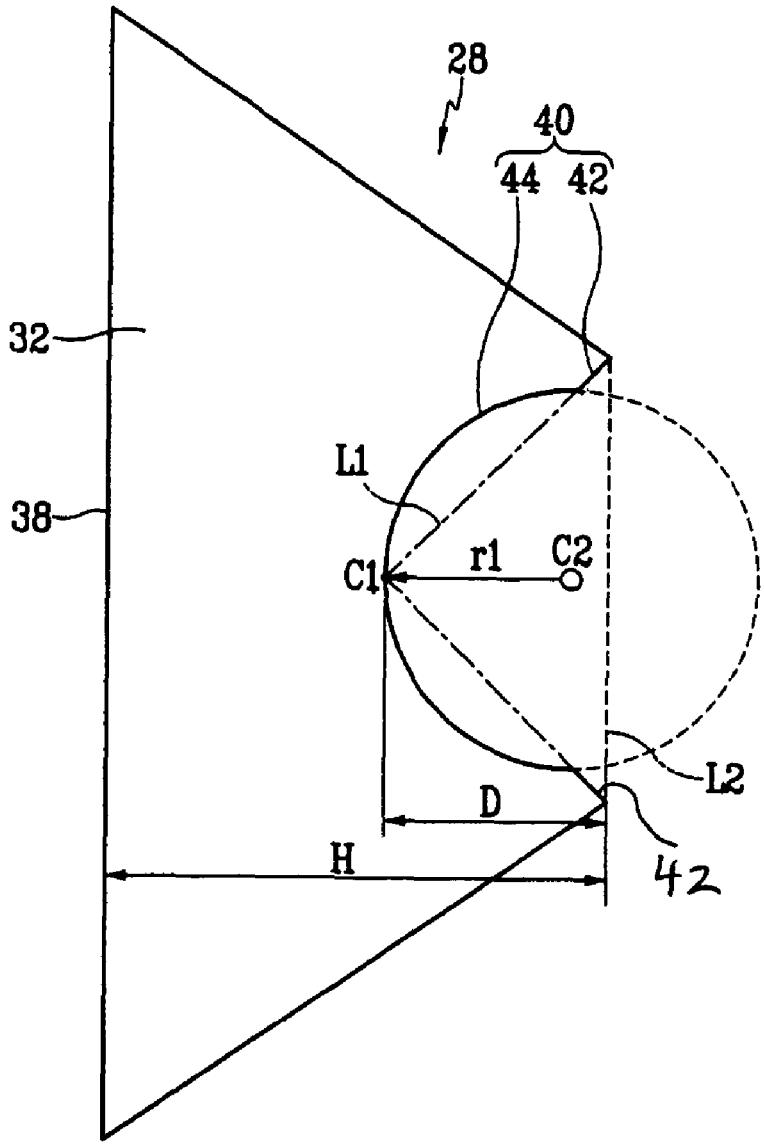
FIG. 6 is a side view of the inner shield of FIG. 5.

FIG. 5 is a perspective view of an inner shield according to a first embodiment of the present invention, and FIG. 6 is a side view of the inner shield of FIG. 5. By way of example, application of the inner shield is made to the CRT 10 of FIG. 4.

An inner shield 28 of the first embodiment of the present invention includes a pair of long sections 30 provided opposing one another in a vertical direction (y-axis direction), and a pair of short sections 32 provided opposing one another in a horizontal direction (x-axis direction). The long sections 30 and the short sections 32 are interconnected to encompass a section of the path of the electron beams emitted from the electron gun 20.

Flanges 34 are formed along edges of the long sections 30 closest to the phosphor screen 12' of the face panel 12 when the inner shield 28 is mounted within the CRT 10. The flanges 34 are connected to the mask frame 26 to thereby realize the mounting of the inner shield 28 within the tube assembly 18 of the CRT 10. An electron gun opening 36 and a screen opening 38 are defined by the long sections 30 and the short sections 32, and are formed at opposite ends of the inner shield 28. That is, the inner shield 28 is mounted such that the screen opening 38 is adjacent to the shadow mask 24, and the electron gun opening 36 is closest to the electron gun 20.

Further, cutaway sections 40 are formed at the ends of the short sections 32 forming the electron gun opening 36. The cutaway sections 40 act to minimize N-S electron beams movement of the electron beams. Each of the cutaway sections 40 includes two first cutaway sections 42 that are formed each starting from the electron gun opening 36 and extending at a predetermined angle for a predetermined distance toward the screen opening 38, and a second cutaway section 44 formed starting from where each of the first cutaway sections 42 ends and extending in a predetermined circular arc shape for a predetermined distance toward the screen opening 38. As shown in FIG. 6, the circular arc shape of the second cutaway section 44 is formed such that the circular arc extends outside and encompasses two imaginary lines L1. Each of the imaginary line L1 formed between where a respective first cutaway section 42 ends to a furthermost inward point C1 of the second cutaway section 44, that is, the point C1 of the second cutaway section 44 closest to the screen opening 38.

If the second cutaway section 44 is extended using imaginary lines to complete the circle started by its circular arc shape as shown in FIG. 6, a radius r1 of this circle is approximately 75 mm, and a center C2 of the circle is closer to the screen opening 38 than an imaginary line L2 formed connecting points of the first cutaway sections 42 where the first cutaway sections 42 start in the electron gun opening 36.

A height H of the inner shield 28 (i.e., a distance from the screen opening 38 to the electron gun opening 36) for use in a 34-inch CRT is approximately 161 mm. Therefore, the cutaway sections 40 structured in this manner have a depth D that is approximately 46% of the height H of the inner shield 28.

Figure 1A:
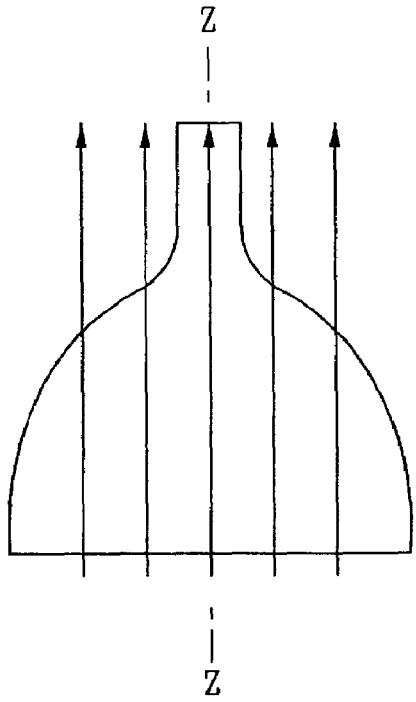
FIGS. 1A and 1B are schematic view used to describe N-S and E-W electron beams movements.
Figure 1B:
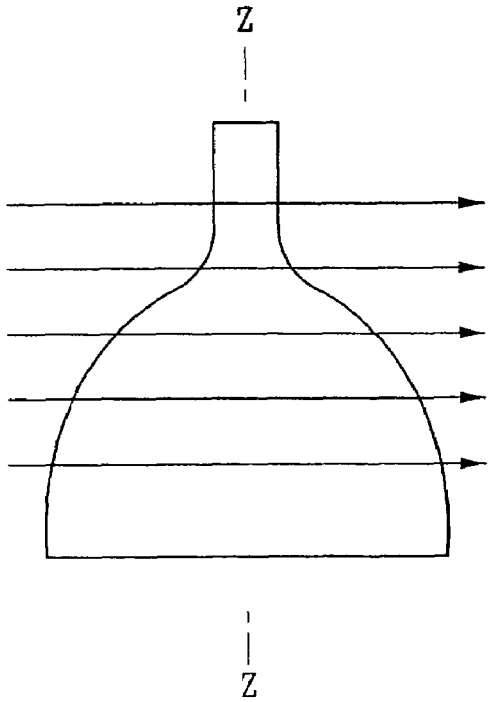
Figure 2:
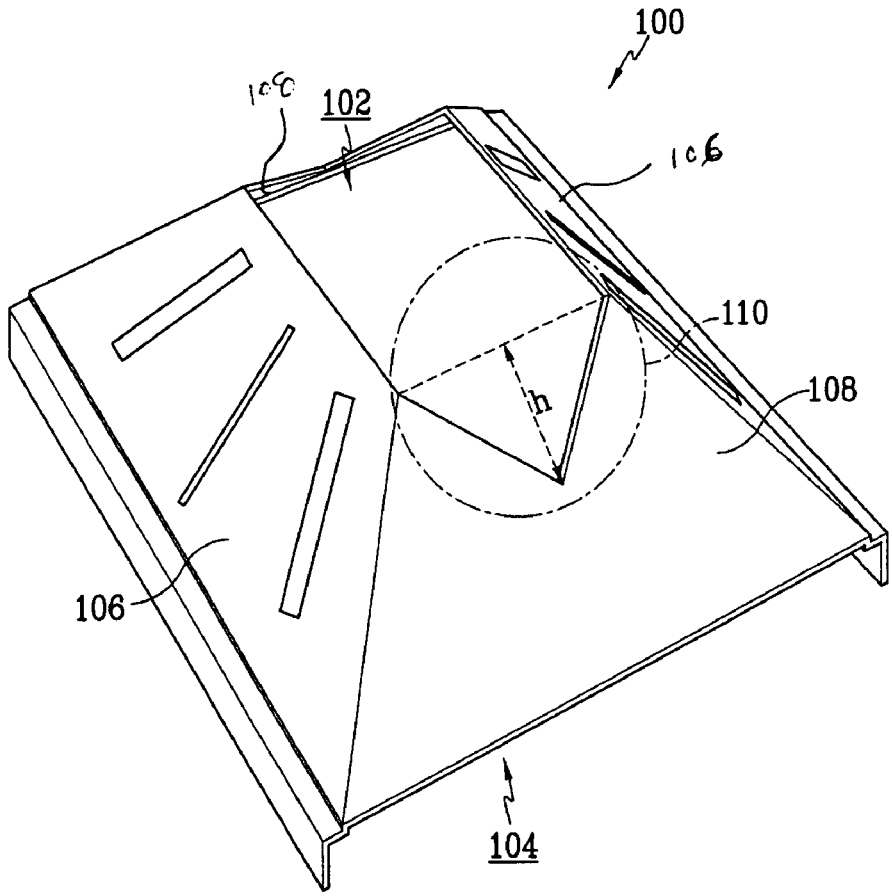
FIG. 2 (PRIOR ART)
FIG. 2 is a perspective view of a conventional inner shield.
Figure 3:
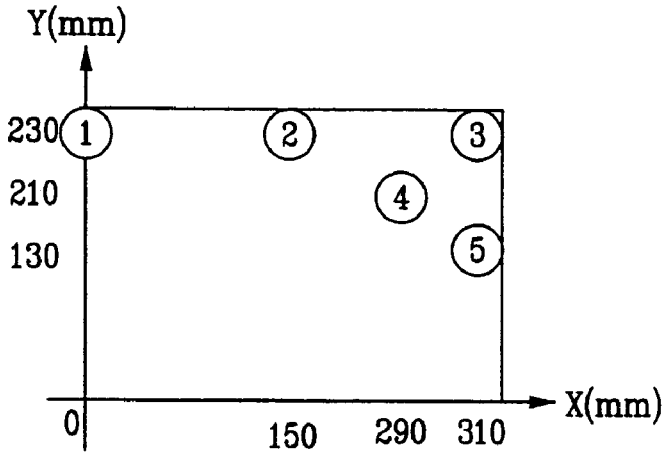
FIG. 3 shows a one-quarter section of a CRT screen and indicates various points at which N-S movement and E-W movement of electron beams caused by external magnetic fields are measured.
Figure 8:
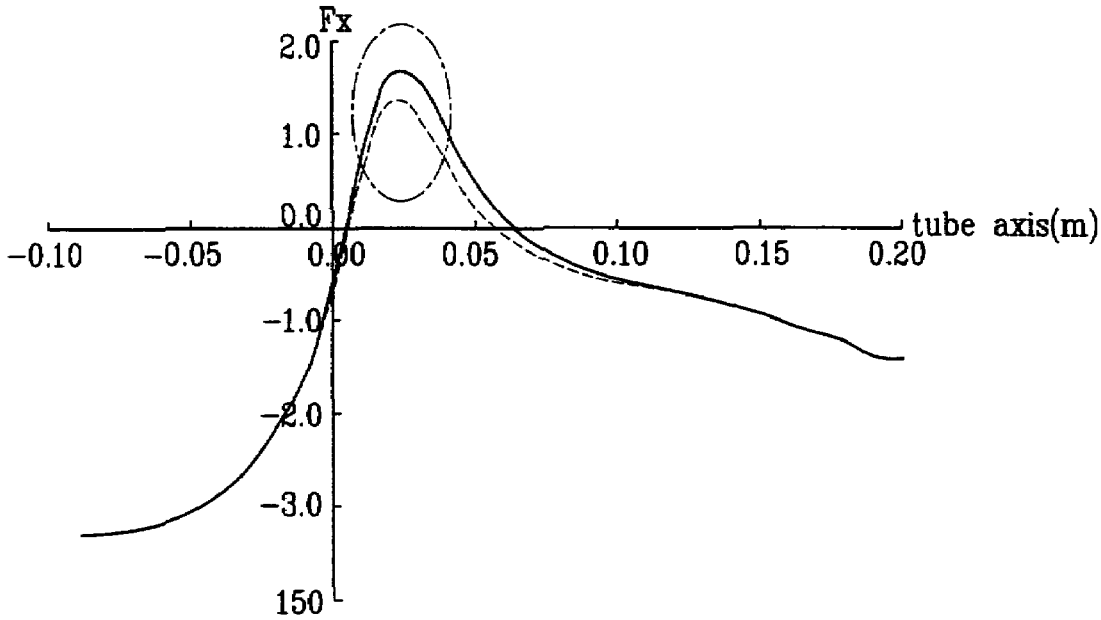
FIG. 8 is a graph used to compare horizontal forces Fx on electron beams moving toward area ④ of FIG. 4, when the inner shield of FIG. 5 and the conventional inner shield are applied to a cathode ray tube.

Results of measuring the horizontal force Fx acting on the electron beams by external magnetic fields while the electron beams emitted from the electron gun 20 are moving in the area ④ of FIG. 3 are shown in the graph of FIG. 8. In FIG. 8, the dotted line curve represents the effect with the conventional inner shield having the V-shaped cutaway sections with a depth that is 46% of the height of the inner shield, and the solid line curve represents the effect with the inner shield 28 of the first embodiment of the present invention illustrated in FIGS. 5 and 6.

The eclipse appearing in FIG. 8 represents the screen opening of the inner shields. It is clear from the drawing that with the use of the inner shield 28 of the first embodiment of the present invention, the horizontal force Fx acting on the electron beams is greater than when using the conventional inner shield. This indicates that in the present invention, the component Bz of the earth's magnetic field in the tube axis direction of the CRT is converted to a greater degree to the component By of the earth's magnetic field in the vertical direction.

Amounts of N-S movement and of E-W movement of the electron beams at each area of measurement (①~⑤) of FIG. 3 are shown in Table 1 below.

TABLE 1

| | N-S Movement (μm) | | | | | E-W Movement (μm) | | | | |
|---|---|---|---|---|---|---|---|---|---|---|
| | ① | ② | ③ | ④ | ⑤ | ① | ② | ③ | ④ | ⑤ |
| Prior Art | 43.6 | 46.9 | 43 | 46.3 | 20.6 | 0 | 39.5 | 63.6 | 53.9 | 42 |
| Embodiment 1 | 42.4 | 44.8 | 35.7 | 38.7 | 10.2 | 0 | 41.42 | 67.07 | 58.01 | 49.86 |

TABLE 1-continued

| | N-S Movement (μm) | | | | | E-W Movement (μm) | | | | |
|---|---|---|---|---|---|---|---|---|---|---|
| | ① | ② | ③ | ④ | ⑤ | ① | ② | ③ | ④ | ⑤ |
| Modified example 1 | 43.25 | 46.2 | 42.24 | 45.08 | 16.52 | 0 | 40.48 | 63.88 | 54.42 | 44.71 |
| Modified example 2 | 41.42 | 42.4 | 21.3 | 28.75 | 12.24 | 0 | 42.39 | 75.2 | 63.95 | 49.47 |

As shown in Table 1, the inner shield 28 of the first embodiment of the present invention significantly reduces N-S movement of the electron beams over the conventional inner shield with the V-shaped cutaway sections of the same depth D as the cutaway sections of the present invention.

Hence, the inner shield 28 of the first embodiment of the present invention significantly reduces N-S movement of the electron beams while preventing an increase in E-W movement of the electron beams. Substantial reductions are realized particularly in areas ③ and ④ indicated in FIG. 3.

Figure 7A:
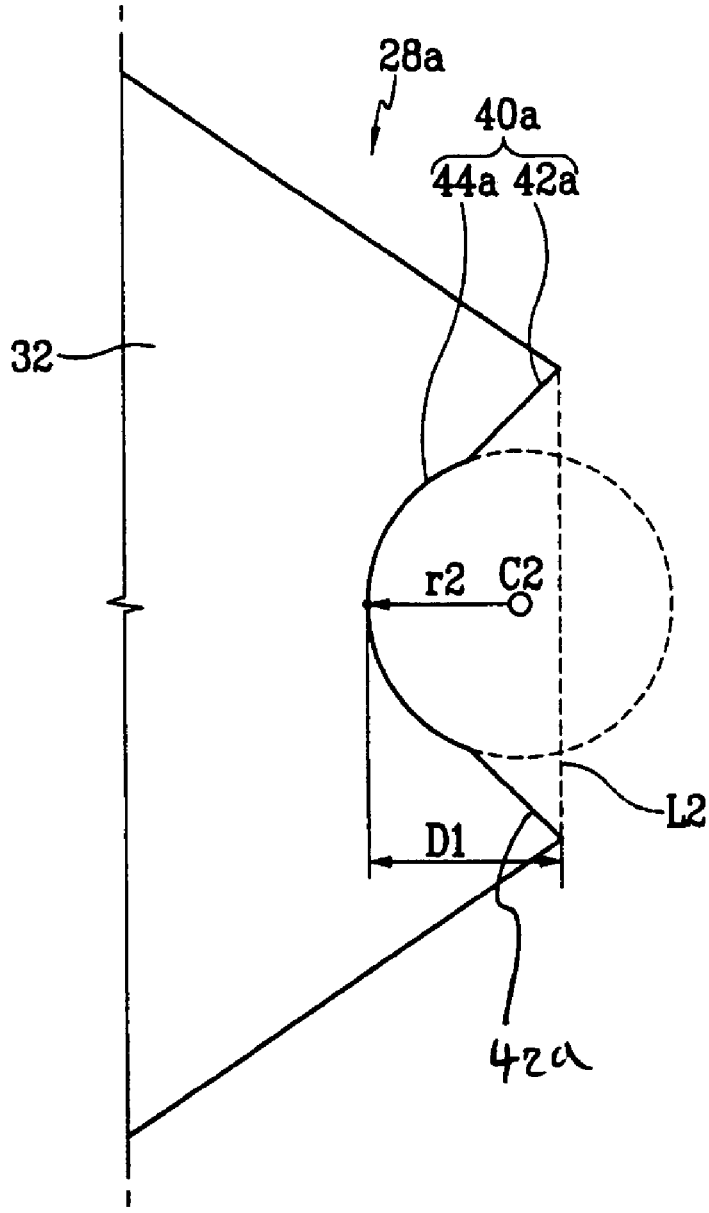
FIGS. 7A, 7B, and 7C are side views of first, second, and third modified examples of the inner shield of FIG. 5 respectively.

FIG. 7A is a side view of a first modified example of the inner shield of FIGS. 5 and 6 of the first embodiment of the present invention. In the first modified example, only the second cutaway sections 44 of the inner shield 28 according to the first embodiment of the present invention are changed in configuration (with a resulting change in the first cutaway sections 42 of the inner shield 28 according to the first embodiment).

In more detail, an inner shield 28*a* of the first modified example includes cutaway sections 40*a* that are formed at the ends of the short sections 32 forming the electron gun opening 36 as in the first embodiment. Each of the cutaway sections 40*a* includes two first cutaway sections 42*a* that are formed starting from the electron gun opening 36 and extending at a predetermined angle for a predetermined distance toward the screen opening 38, and a second cutaway section 44*a* formed starting from where the first cutaway sections 42*a* end and extending in a predetermined arc shape for a predetermined distance toward the screen opening 38.

If each of the second cutaway sections 44*a* is extended using imaginary lines to complete the circle started by its circular arc shape as shown in FIG. 7A, a radius r2 of this circle is 65 mm. This reduction in radius over the first embodiment results in the first cutaway sections 42*a* being formed to a greater length than the first cutaway sections 42 of the first embodiment shown in FIGS. 5 and 6. The remainder of the configuration of the first modified example is identical to that of the first embodiment.

Figure 7B:
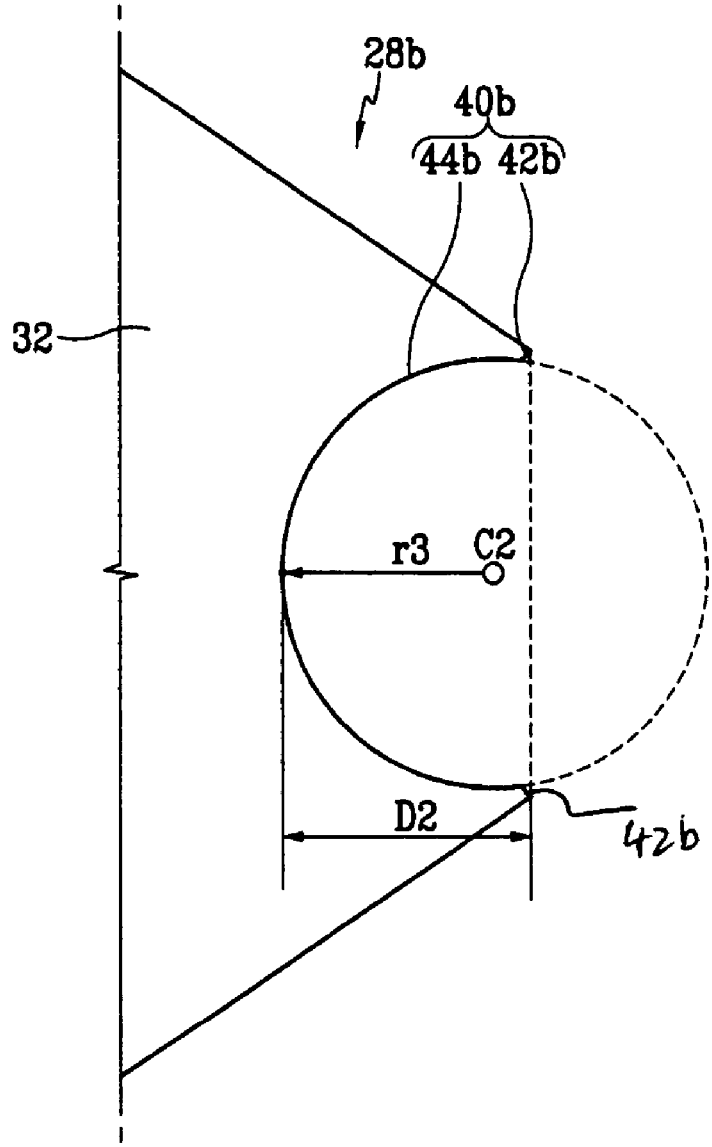

FIG. 7B is a side view of a second modified example of the inner shield of FIGS. 5 and 6 of the first embodiment of the present invention.

An inner shield 28*b* of the second modified example includes cutaway sections 40*b* that are formed at the ends of the short sections 32 forming the electron gun opening 36 as in the first embodiment. Each of the cutaway sections 40*b* includes two first cutaway sections 42*b* that are formed starting from the electron gun opening 36 and extending at a predetermined angle for a predetermined distance toward the screen opening 38, and a second cutaway section 44*b* formed starting from where the first cutaway sections 42*b* end and extending in a predetermined circular arc shape for a predetermined distance toward the screen opening 38.

If each of the second cutaway sections 44*b* is extended using imaginary lines to complete the circle started by its circular arc shape as shown in FIG. 7B, a radius r3 of this circle is approximately 85 mm. This increase in radius over the first embodiment results in the first cutaway sections 42*b* being formed with a smaller length than the first cutaway sections 42 of the first embodiment shown in FIGS. 5 and 6. The remainder of configuration of the second modified example is identical to that of the first embodiment.

N-S movement and E-W movement test results for the first and second modified examples of FIGS. 7A and 7B also appear in Table 1 respectively.

The inner shields 28 and 28*a* of the first embodiment and of the first modified example may be applied to both CPT(color picture tube)s and CDT(color display tube)s. This is because with these inner shields 28 and 28*a*, the depths D and D1 of the cutaway sections 40 and 40*a* are less than 50% of the heights H of the inner shields 28 and 28*a*, thereby preventing a reduction in picture quality caused by increases in E-W electron beam movement.

The CPTs mentioned above refer to CRTs having slot-shaped phosphors on the phosphor screen 12' that experience a reduction in picture quality with increases in E-W electron beams movement. The CDTs refer to CRTs having dot-shaped phosphors on the phosphor screen 12 in which E-W electron beams movement is limited such that picture quality is not significantly affected by the E-W movement.

As described above, the depths D and D1 of the cutaway sections 40 and 40*a* are less than 50% of the inner shield heights H. Preferably, the depths D and D1 of the cutaway sections 40 and 40*a* are between 40% and 48% of the heights H of the inner shields 28 and 28*a* to thereby allow application of the inner shield to both CPTs and CDTs.

With respect to the second modified example of FIG. 7B, since the depth D2 of the cutaway section 40*b* is greater than 50% of the inner shield height H, the inner shield 28*b* of this modified example may be applied to CDTs.

Figure 7C:
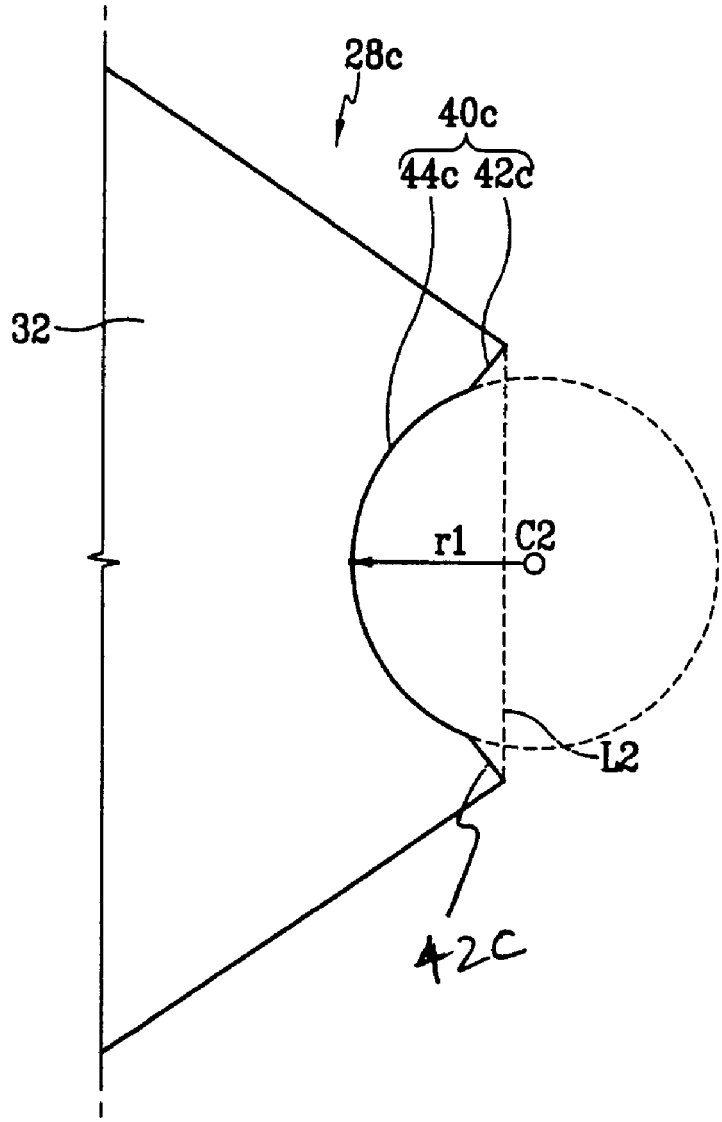

FIG. 7C is a side view of a third modified example of the inner shield of FIGS. 5 and 6 of the first embodiment of the present invention.

An inner shield 28*c* of the second modified example includes cutaway sections 40*c* that are formed at the ends of the short sections 32 forming the electron gun opening 36 as in the first embodiment. Each of the cutaway sections 40*c* includes two first cutaway sections 42*c* that are formed starting from the electron gun opening 36 and extending at a predetermined angle for a predetermined distance toward the screen opening 38, and a second cutaway section 44*c* formed starting from where the first cutaway sections 42*c* end and extending in a predetermined circular arc shape for a predetermined distance toward the screen opening 38.

If each of the second cutaway section 44*c* is extended using imaginary lines to complete the circle started by its circular arc shape, as shown in FIG. 7C, a center C2 of the circle is positioned outside of the area encompassed by the inner shield 28*c*. That is, the center C2 of the circles is positioned farther from the screen opening 38 than an imaginary line L2 formed by connecting points of the first cutaway sections 42*c* where the first cutaway sections 42*c* start in the electron gun opening 36.

Figure 10:
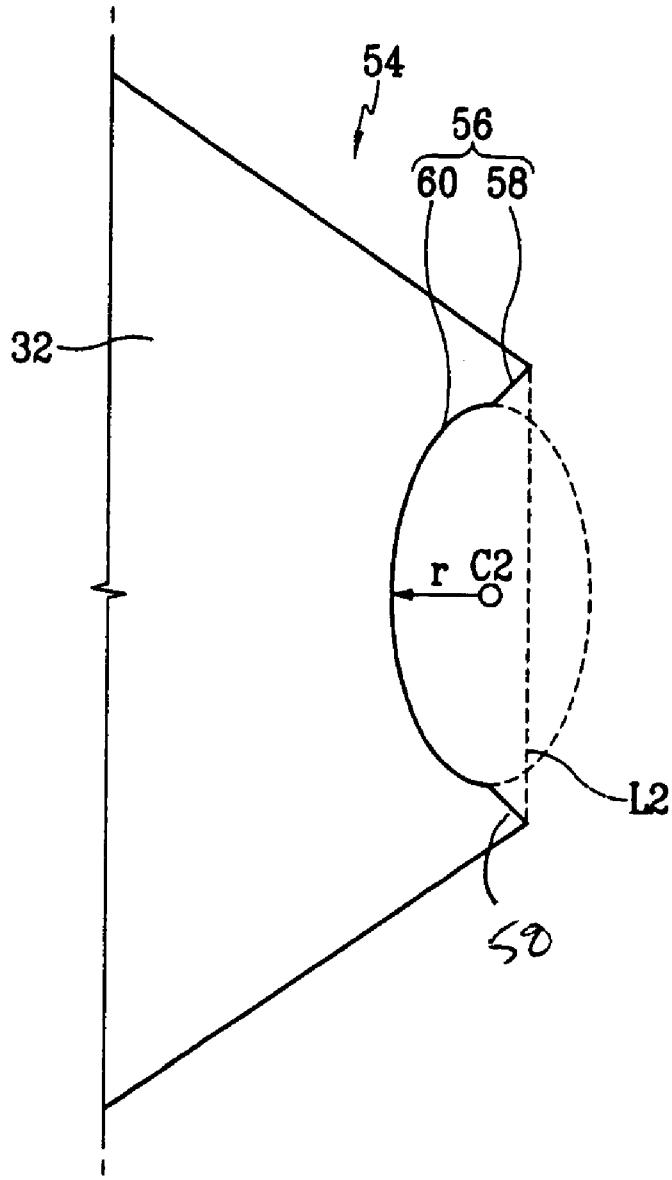
FIG. 10 is a side view of an inner shield, according to a third embodiment of the present invention.
Figure 11:
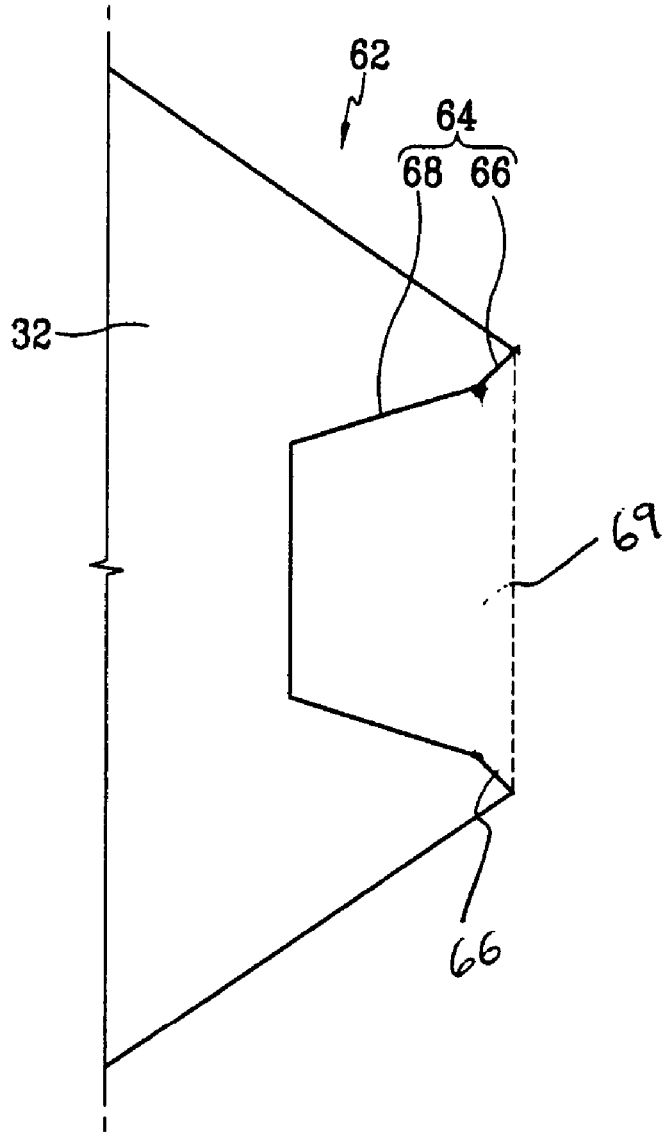
FIG. 11 is a side view of an inner shield, according to a fourth embodiment of the present invention.

In the above examples, the second cutaway sections 44, 44*a*, 44*b*, and 44*c* are described as being formed in circular arc shapes. However, as long as the second cutaway section extends outside and encompass imaginary lines formed from where the first cutaway sections end to a furthermost inward point of the second cutaway sections, the second cutaway sections may be formed in a variety of different configurations. Examples of such different configurations are shown in FIGS. 9, 10, and 11.

Figure 9:
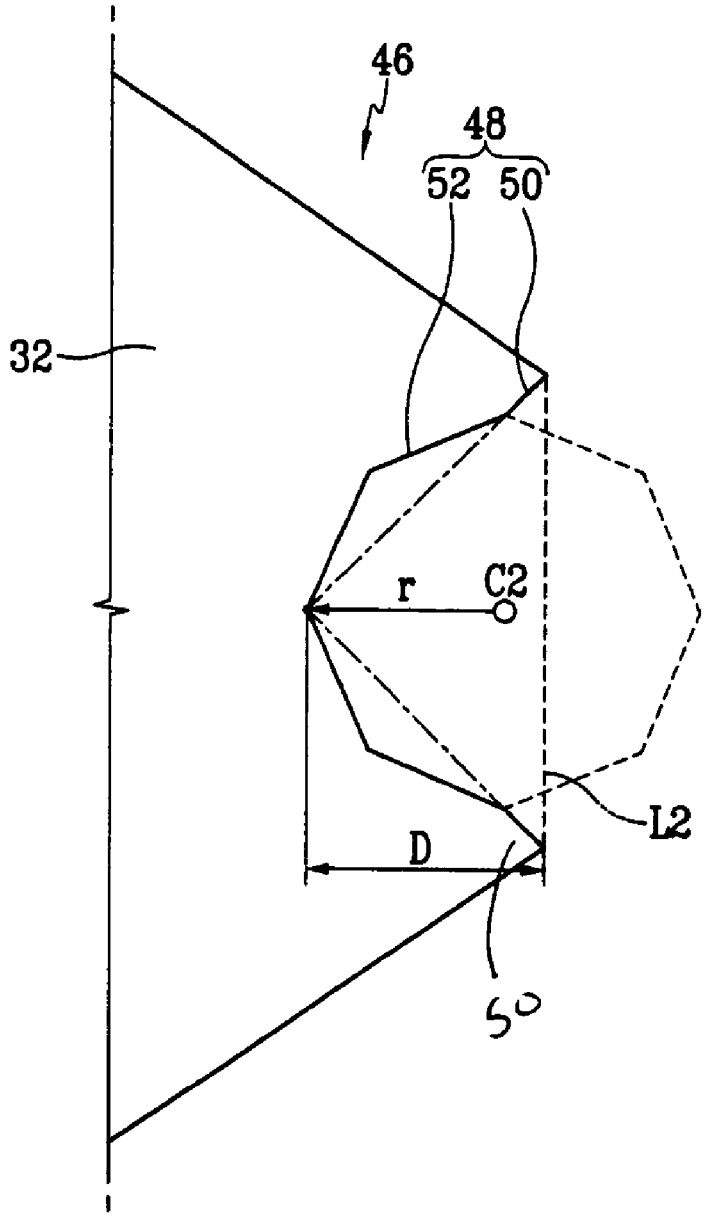
FIG. 9 is a side view of an inner shield, according to a second embodiment of the present invention.

FIG. 9 is a side view of an inner shield according to a second embodiment of the present invention.

As shown in FIG. 9, an inner shield 46 of the second embodiment includes cutaway sections 48 that are formed at the ends of short sections 32 forming an electron gun opening 36, as in the first embodiment. Each of the cutaway sections 48 includes two first cutaway sections 50 that are formed starting from the electron gun opening 36 and extending at a predetermined angle for a predetermined distance toward the screen opening 38, and a second cutaway section 52 formed starting from where the first cutaway sections 50 end, and extending in a predetermined configuration for a predetermined distance toward the screen opening 38.

If the second cutaway section 52 is extended using imaginary lines, as shown in FIG. 9, the second cutaway section 52 is formed into a multilateral shape such as an octagon. In this case, the second cutaway sections 52 form four sides of the octagon. Depending on CRT type and characteristics, a center C2 of the octagon may be positioned farther from or closer to the screen opening 38 than an imaginary line L2 formed by connecting points of the first cutaway sections 50 where the first cutaway sections 50 start in the electron gun opening 36. Further, a distance r from the center C2 to one of the corners of the octagon and a depth D of the cutaway sections 48 may be varied as needed.

FIG. 10 is a side view of an inner shield according to a third embodiment of the present invention.

As shown in FIG. 10, an inner shield 54 of the third embodiment includes cutaway sections 56 that are formed at the ends of short sections 32 forming an electron gun opening 36 as in the first embodiment. Each of the cutaway sections 56 includes two first cutaway sections 58 that are formed starting from the electron gun opening 36 and extending at a predetermined angle for a predetermined distance toward the screen opening 38, and a second cutaway section 60 formed starting from where the first cutaway sections 58 end and extending in a predetermined configuration for a predetermined distance toward the screen opening 38.

If the second cutaway section 60 is extended using imaginary lines as shown in FIG. 9, the second cutaway section 60 is formed into an elliptical shape. Although not shown, the second cutaway section 60 may also be formed into a multilateral configuration that has the general overall shape of an ellipse. In the case of the elliptical formation of the second cutaway section 60 shown in the drawing, the second cutaway section 60 may be varied in its dimensions, that is, a distance r from a center C2 of the ellipse to an end point of the minor axis (i.e., to one of the co-vertices) may be varied as needed.

FIG. 11 is a side view of an inner shield according to a fourth embodiment of the present invention.

As shown in FIG. 11, an inner shield 62 of the fourth embodiment includes cutaway sections 64 that are formed at the ends of short sections 32 forming an electron gun opening 36 as in the first embodiment. Each of the cutaway sections 64 includes two first cutaway sections 66 that are formed starting from the electron gun opening 36 and extending at a predetermined angle for a predetermined distance toward the screen opening 38, and a second cutaway section 68 formed starting from where the first cutaway sections 66 end and extending in a predetermined configuration for a predetermined distance toward the screen opening 38.

For each of the cutaway sections 64, if an imaginary line 69 is drawn between two points where the first cutaway sections 66 end (or where the second cutaway section 68 begins), the second cutaway section 68 is formed as a trapezoid with the imaginary line 69 forming the base of the trapezoid.

As described above, the inner shield of the present invention having first and second cutaway sections effectively reduces N-S movement of the electron beams at all areas of the screen and that are caused by external magnetic fields, while preventing an increase in E-W movement. Therefore, a reduction in purity, raster distortion, and convergence characteristic variations caused by external magnetic fields such as the earth's magnetic field are minimized.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An inner shield for a cathode ray tube, comprising:

a screen opening and an electron gun opening through which electron beams pass; and a main body including a pair of long sections and a pair of short sections interconnected to form the screen opening and the electron gun opening, wherein each of the short sections includes a cutaway section having a pair of first cutaway sections formed starting from the electron gun opening and extending at a predetermined angle for a predetermined distance toward the screen opening, and a second cutaway section formed starting from where the first cutaway sections end and extending inwardly toward the screen opening, the second cutaway sections being formed to extend past imaginary lines formed along the first cutaway sections, respectively to a furthermost inward point of the second cutaway section, that is, the point of the second cutaway section closest to the screen opening.

2. An inner shield for a cathode ray tube, comprising:

a screen opening and an electron gun opening through which electron beams pass; and a main body including a pair of long sections and a pair of short sections interconnected to form the screen opening and the electron gun opening, wherein each of the short sections includes a cutaway section having a pair of first cutaway sections formed starting from the electron gun opening and extending at a predetermined angle for a predetermined distance toward the screen opening, and a second cutaway section formed starting from where the first cutaway sections end and extending inwardly toward the screen opening, the second cutaway sections being formed to extend past imaginary lines formed from where the first cutaway sections end to a furthermost inward point of the second cutaway section, that is, the point of the second cutaway section closest to the screen opening, wherein each of the second cutaway sections is formed as a circular arc or in substantially a circular arc configuration.

3. The inner shield of claim 2, wherein if a height of the inner shield measured as a length between the electron gun opening and the screen opening is H, and a depth of the cutaway sections in the same direction is D, the depth D of the cutaway sections satisfies $0.4H \leqq D < 0.5H$.

4. The inner shield of claim 2, wherein if a height of the inner shield measured as a length between the electron gun opening and the screen opening is H, and a depth of the cutaway sections in the same direction is D, the depth D of the cutaway sections satisfies $D \geqq 0.5H$.

5. The inner shield of claim 2, wherein if each of the second cutaway sections is extended using imaginary lines to complete the circle started by its circular arc shape, a center of this circle is closer to the screen opening than an imaginary line formed connecting points of the first cutaway sections where the first cutaway sections start in the electron gun opening.

6. The inner shield of claim 2, wherein if each of the second cutaway sections is extended using imaginary lines to complete the circle started by its circular arc shape, a center of this circle is farther from the screen opening than an imaginary line formed connecting points of the first cutaway sections where the first cutaway sections start in the electron gun opening.

7. An inner shield for a cathode ray tube, comprising:

a screen opening and an electron gun opening through which electron beams pass; and a main body including a pair of long sections and a pair of short sections interconnected to form the screen opening and the electron gun opening, wherein each of the short sections includes a cutaway section having a pair of first cutaway sections formed starting from the electron gun opening and extending at a predetermined angle for a predetermined distance toward the screen opening, and a second cutaway section formed starting from where the first cutaway sections end and extending inwardly toward the screen opening, the second cutaway sections being formed to extend past imaginary lines formed from where the first cutaway sections end to a furthermost inward point of the second cutaway section, that is, the point of the second cutaway section closest to the screen opening, wherein each of the second cutaway sections is formed as a predetermined section of an ellipse or in substantially an elliptical form.

8. The inner shield of claim 7, wherein if a height of the inner shield measured as a length between the electron gun opening and the screen opening is H, and a depth of the cutaway sections in the same direction is D, the depth D of the cutaway sections satisfies $0.4H \leqq D < 0.5H$.

9. The inner shield of claim 7, wherein if a height of the inner shield measured as a length between the electron gun opening and the screen opening is H, and a depth of the cutaway sections in the same direction is D, the depth D of the cutaway sections satisfies $D \geqq 0.5H$.

10. The inner shield of claim 7, wherein if each of the second cutaway sections is extended using imaginary lines to complete the ellipse, a center of this ellipse is closer to the screen opening than an imaginary line formed connecting points of the first cutaway sections where the first cutaway sections start in the electron gun opening.

11. The inner shield of claim 7, wherein if each of the second cutaway sections is extended using imaginary lines to complete the ellipse, a center of this circle is farther from the screen opening than an imaginary line formed connecting points of the first cutaway sections where the first cutaway sections start in the electron gun opening.

12. An inner shield for a cathode ray tube, comprising:

a screen opening and an electron gun opening through which electron beams pass; and a main body including a pair of long sections and a pair of short sections interconnected to form the screen opening and the electron gun opening, wherein each of the short sections includes a cutaway section having a pair of first cutaway sections formed starting from the electron gun opening and extending at a predetermined angle for a predetermined distance toward the screen opening, and a second cutaway section formed starting from where the first cutaway sections end and extending inwardly toward the screen opening, the second cutaway sections being formed to extend past imaginary lines formed from where the first cutaway sections end to a furthermost inward point of the second cutaway section, that is, the point of the second cutaway section closest to the screen opening, wherein if an imaginary line is drawn between two points where the second cutaway sections begin, each of the second cutaway sections is formed as a trapezoid with the imaginary line forming the base of the trapezoid.

13. A cathode ray tube having an inner shield, comprising:

a tube assembly including a face panel, a funnel, and a neck; and an inner shield including a screen opening and an electron gun opening through which electron beams pass, and a main body including a pair of long sections and a pair of short sections interconnected to form the screen opening and the electron gun opening, the inner shield being mounted within the tube assembly surrounding a section of a path of electron beams, wherein each of the short sections includes a cutaway section having a pair of first cutaway sections formed starting from the electron gun opening and extending at a predetermined angle for a predetermined distance toward the screen opening, and a second cutaway section formed starting from where the first cutaway sections end and extending inwardly toward the screen opening, the second cutaway sections being formed to extend past imaginary lines formed along the first cutaway sections, respectively to a furthermost inward point of the second cutaway section, that is, the point of the second cutaway section closest to the screen opening.

14. A cathode ray tube having an inner shield, comprising:

a tube assembly including a face panel, a funnel, and a neck; and an inner shield including a screen opening and an electron gun opening through which electron beams pass, and a main body including a pair of long sections and a pair of short sections interconnected to form the screen opening and the electron gun opening, the inner shield being mounted within the tube assembly surrounding a section of a path of electron beams, wherein each of the short sections includes a cutaway section having a pair of first cutaway sections formed starting from the electron gun opening and extending at a predetermined angle for a predetermined distance toward the screen opening, and a second cutaway section formed starting from where the first cutaway sections end and extending inwardly toward the screen opening, the second cutaway sections being formed to extend past imaginary lines formed from where the first cutaway sections end to a furthermost inward point of the second cutaway section, that is, the point of the second cutaway section closest to the screen opening, wherein each of the second cutaway sections of the inner shield is formed as a circular arc or in substantially a circular arc configuration.

15. The cathode ray tube of claim 14, wherein if a height of the inner shield measured as a length between the electron gun opening and the screen opening is H, and a depth of the cutaway sections in the same direction is D, the depth D of the cutaway sections satisfies $0.4H \leqq D < 0.5H$.

16. The cathode ray tube of claim 14, wherein if a height of the inner shield measured as a length between the electron gun opening and the screen opening is H, and a depth of the cutaway sections in the same direction is D, the depth D of the cutaway sections satisfies $D \geqq 0.5H$.

17. The cathode ray tube of claim 14, wherein if each of the second cutaway sections of the inner shield is extended using imaginary lines to complete the circle started by its circular arc shape, a center of this circle is closer to the screen opening than an imaginary line formed connecting points of the first cutaway sections where the first cutaway sections start in the electron gun opening.

18. The cathode ray tube of claim 14, wherein if each of the second cutaway sections of the inner shield is extended using imaginary lines to complete the circle started by its circular arc shape, a center of this circle is farther from the screen opening than an imaginary line formed connecting points of the first cutaway sections where the first cutaway sections start in the electron gun opening.

19. A cathode ray tube having an inner shield, comprising:

a tube assembly including a face panel, a funnel, and a neck; and an inner shield including a screen opening and an electron gun opening through which electron beams pass, and a main body including a pair of long sections and a pair of short sections interconnected to form the screen opening and the electron gun opening, the inner shield being mounted within the tube assembly surrounding a section of a path of electron beams, wherein each of the short sections includes a cutaway section having a pair of first cutaway sections formed starting from the electron gun opening and extending at a predetermined angle for a predetermined distance toward the screen opening, and a second cutaway section formed starting from where the first cutaway sections end and extending inwardly toward the screen opening, the second cutaway sections being formed to extend past imaginary lines formed from where the first cutaway sections end to a furthermost inward point of the second cutaway section, that is, the point of the second cutaway section closest to the screen opening, wherein each of the second cutaway sections of the inner shield is formed as a predetermined section of an ellipse or in substantially an elliptical form.

20. The cathode ray tube of claim 19, wherein if a height of the inner shield measured as a length between the electron gun opening and the screen opening is H, and a depth of the cutaway sections in the same direction is D, the depth D of the cutaway sections satisfies $0.4H \leqq D < 0.5H$.

21. The cathode ray tube of claim 19, wherein if a height of the inner shield measured as a length between the electron gun opening and the screen opening is H, and a depth of the cutaway sections in the same direction is D, the depth D of the cutaway sections satisfies $D \geqq 0.5H$.

22. The cathode ray tube of claim 19, wherein if each of the second cutaway sections of the inner shield is extended using imaginary lines to complete the ellipse, a center of this ellipse is closer to the screen opening than an imaginary line formed connecting points of the first cutaway sections where the first cutaway sections start in the electron gun opening.

23. The cathode ray tube of claim 19, wherein if each of the second cutaway sections of the inner shield is extended using imaginary lines to complete the ellipse, a center of this circle is farther from the screen opening than an imaginary line formed connecting points of the first cutaway sections where the first cutaway sections start in the electron gun opening.

24. A cathode ray tube having an inner shield, comprising:

a tube assembly including a face panel, a funnel, and a neck; and an inner shield including a screen opening and an electron gun opening through which electron beams pass, and a main body including a pair of long sections and a pair of short sections interconnected to form the screen opening and the electron gun opening, the inner shield being mounted within the tube assembly surrounding a section of a path of electron beams, wherein each of the short sections includes a cutaway section having a pair of first cutaway sections formed starting from the electron gun opening and extending at a predetermined angle for a predetermined distance toward the screen opening, and a second cutaway section formed starting from where the first cutaway sections end and extending inwardly toward the screen opening, the second cutaway sections being formed to extend past imaginary lines formed from where the first cutaway sections end to a furthermost inward point of the second cutaway section, that is, the point of the second cutaway section closest to the screen opening, wherein if an imaginary line is drawn between two points where the second cutaway sections begin, each of the second cutaway sections is formed as a trapezoid with the imaginary line forming the base of the trapezoid.

* * * * *